US007063582B2

(12) United States Patent
Boujon

(10) Patent No.: US 7,063,582 B2
(45) Date of Patent: Jun. 20, 2006

(54) REVERSIBLE LIFE RAFT COMPRISING REMOVABLE SHELTERS

(76) Inventor: Claire-Lise Boujon, 33 rue de Montbrillant, CH 1202, Geneva (CH)

( * ) Notice: Subject to any disclaimer, the term of this patent is extended or adjusted under 35 U.S.C. 154(b) by 0 days.

(21) Appl. No.: 10/474,317

(22) PCT Filed: Mar. 25, 2002

(86) PCT No.: PCT/CH02/00172

§ 371 (c)(1),
(2), (4) Date: Dec. 10, 2004

(87) PCT Pub. No.: WO02/079027

PCT Pub. Date: Oct. 10, 2002

(65) Prior Publication Data

US 2005/0095932 A1 May 5, 2005

(30) Foreign Application Priority Data

Apr. 1, 2001 (CH) ..... 0607/01
Feb. 26, 2002 (CH) ..... 0333/02

(51) Int. Cl.
*B63B 35/58* (2006.01)

(52) U.S. Cl. ..... 441/38; 441/40

(58) Field of Classification Search ..... 441/35, 441/37, 38, 40, 41, 42, 80, 39; 135/88.13, 135/901

See application file for complete search history.

(56) References Cited

U.S. PATENT DOCUMENTS

| | | | | |
|---|---|---|---|---|
| 1,727,902 | A * | 9/1929 | Reno | 441/80 |
| 3,781,933 | A * | 1/1974 | Soter | 441/40 |
| 4,088,363 | A * | 5/1978 | Palmer | 296/161 |
| 4,678,443 | A * | 7/1987 | Edwards et al. | 441/38 |
| 4,766,918 | A * | 8/1988 | Odekirk | 52/2.23 |
| 5,692,795 | A * | 12/1997 | Mininger | 296/164 |
| 6,574,804 | B1 * | 6/2003 | Boujon | 4/504 |

FOREIGN PATENT DOCUMENTS

| | | |
|---|---|---|
| DE | 32 10 590 A | 10/1983 |
| FR | 2 678 669 A | 1/1993 |
| GB | 1 101 585 A | 1/1968 |
| WO | WO 01 06076 A | 1/2001 |

OTHER PUBLICATIONS

International Search Report.

* cited by examiner

*Primary Examiner*—Sherman Basinger
(74) *Attorney, Agent, or Firm*—Abelman, Frayne & Schwab

(57) ABSTRACT

A dual-sided, or reversible, inflatable rescue and safety raft consists of an inflated grille provided with mesh netting spanning open regions to accommodate personnel, manually releasable locking devices that close access openings in the netting to permit personnel to board from underneath the floating grille, both surfaces of the grille being provided with fasteners for safety handles and belts; one or more containers with compactly folded modular floor and shelter units that can be fastened to the surface of the grille (or removed from the raft for use as tents on land) are repositionably secured to the grille in the event that the containers are submerged when the raft is initially disposed in the water.

21 Claims, 8 Drawing Sheets

FIGURE 9 A
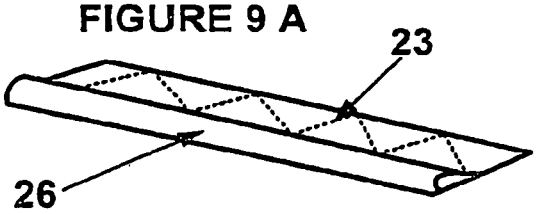
FIGURE 9 B
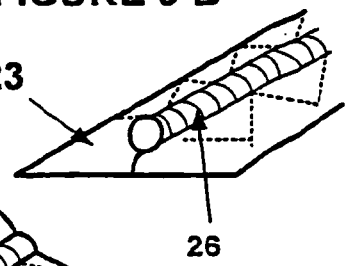
FIGURE 9 C
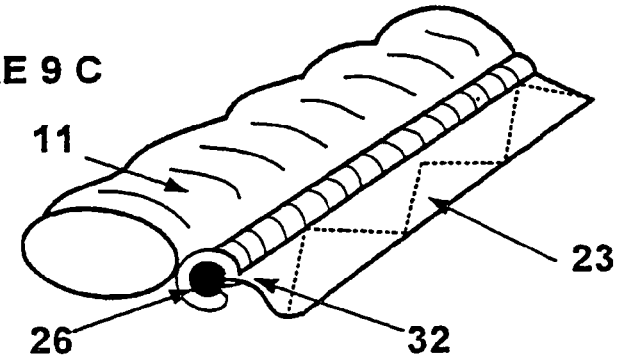
FIGURE 10 A
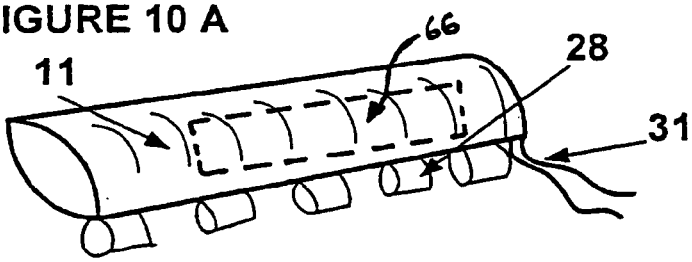
FIGURE 10 B
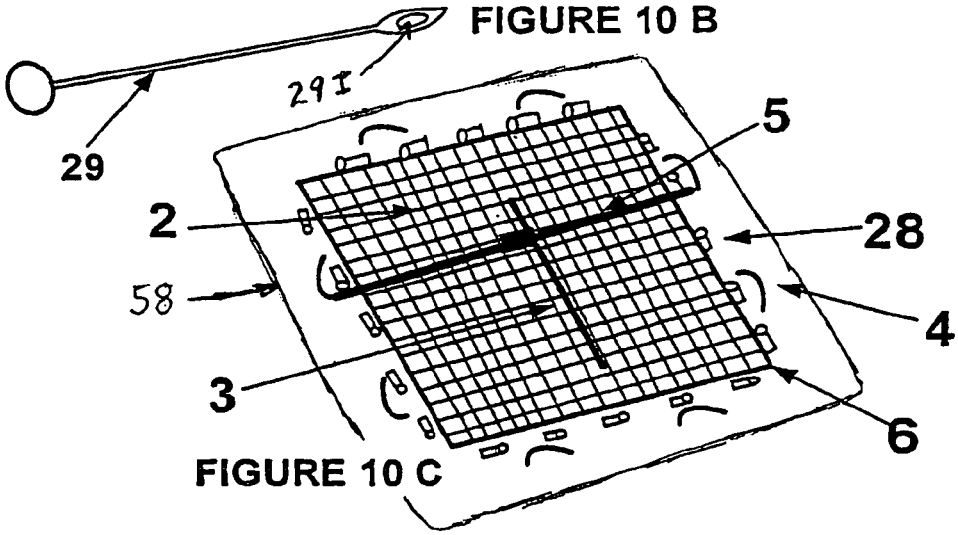
FIGURE 10 C

REVERSIBLE LIFE RAFT COMPRISING REMOVABLE SHELTERS

FIELD OF THE INVENTION

This invention relates to inflatable rescue and safety apparatus for receiving personnel in aquatic environments and, in particular, to such apparatus and devices as are carried aboard airplanes and ships whose passengers are at peril from exposure to the elements in the event that the craft goes down at the sea.

BACKGROUND OF THE INVENTION

This invention is an improvement on my inflatable rescue and safety apparatus described in U.S. Pat. No. 6,574,804 B1, the entire disclosure of which is incorporated herein by reference.

According to the prior art publication of PCT/CH99/00619 the object, of the device disclosed is to provide raft having a greater surface area for personnel, at the sea, wherein an ordinary boat operates and permits someone stuck beneath the device, when it inflates, to move onto the device and to stay there by means of releasable spreadable and re-lockable openings that permit shipwrecked persons to grasp the netting in order to rejoin one of the openings. It also allows survivors, if required, to hold on by hands and feet using handles and safety belts. However, survivors are neither protected from the weather and exposure in a cold sea, waves that can pass through the netting, and exposure to the sun, should the raft be disposed upside-down, shipwrecked persons will not have access to the handles and safety belts.

According to the prior art patent document DE 3210 590 A1, a device is disclosed for use in open water, which is a multiple-person buoy without netting, the tarpaulins of which cover a certain number of openings, and do not form a floor on all the surface. Shelters are provided, but they are located on certain units, they are fixed and they do not communicate with each other but form multiple spaces.

Children can slide into the openings, survivors can encounter waves, water can stagnate in the tarpaulins and form pockets there, and when survivors are in the shelter, an imbalance will be created and the multiple buoy will be returned. This situation can get worse when units are coupled in a rough sea, because nothing assures that shelters are arranged head-to-tail in order to balance loads. On the contrary, in the panic condition, unfortunately, it is impossible to perform such operation, and many persons will likely be exposed to water and the weather conditions.

Rescue boats and rafts that are currently available in the market provide only a small surface area, with capacity for a limited number of persons on board. Moreover, aircraft slides and toboggans require skillful folding with a link system in the form of snap fasteners so that they are opened in the correct orientations.

It is, therefore, an object of the present invention to provide an inflatable rescue and safety flotation device that is able to overcome these drawbacks.

SUMMARY OF THE INVENTION

The above objects and other advantages are achieved by the inflatable rescue raft of the invention that is made totally reversible by the use of handles and mating fasteners that are distributed on both sides of the raft and safety belts that can be accessed for use, regardless of the original orientation of the raft. The raft is also equipped with modular units containing a floor and personnel shelter that mates with the fasteners on the surfaces of the raft. The shelters can be joined to form interconnecting multiple spaces or erected at a single selected location on the surface of the raft without regard to the orientation of the initial opening of the raft.

The invention will be fully understood by reading the description which follows of the several embodiments provided as non-restrictive examples and with regards to the underlying figures.

DESCRIPTION OF THE DRAWINGS

FIG. 9*a* shows a sewn fabric strip 23 extended by a seal bead 26.

FIG. 9*b* shows a sewn fabric strip 23 with a fixed seal bead or seam 26 in its surroundings.

FIG. 9*c* shows the bag 11 with a tube having a slit 32 and a seal bead 26, threaded to the slit 32 of the tube.

FIG. 10*a* shows a bag 11, on the edge of which fixed tubular loop sections 28 are provided, and at the end of which two flexible fasteners 31, e.g. lengths of cord, are provided.

FIG. 10*b* is a tie rod 29 near the bag 11, provided at one end with a handle 29H and at the other end an eye 29I.

FIG. 10*c* shows an inflatable grille member 58 provided with the mesh netting 2. The mesh netting 2 includes a resealable personnel access opening 3, handles 4, tubular loop sections 28, which can be flexible or rigid, secured to the grille for receiving tubular loop sections 28 that are affixed to the bag 11 (FIG. 10*a*), and adapted to be aligned with those affixed to the inflatable member 58. They are joined in mating alignment by the rod 29 and the hole 29I will be attached by two fasteners 31 joined to an end of the bag 11.

DETAILED DESCRIPTION OF PREFERRED EMBODIMENTS

Figure 1:
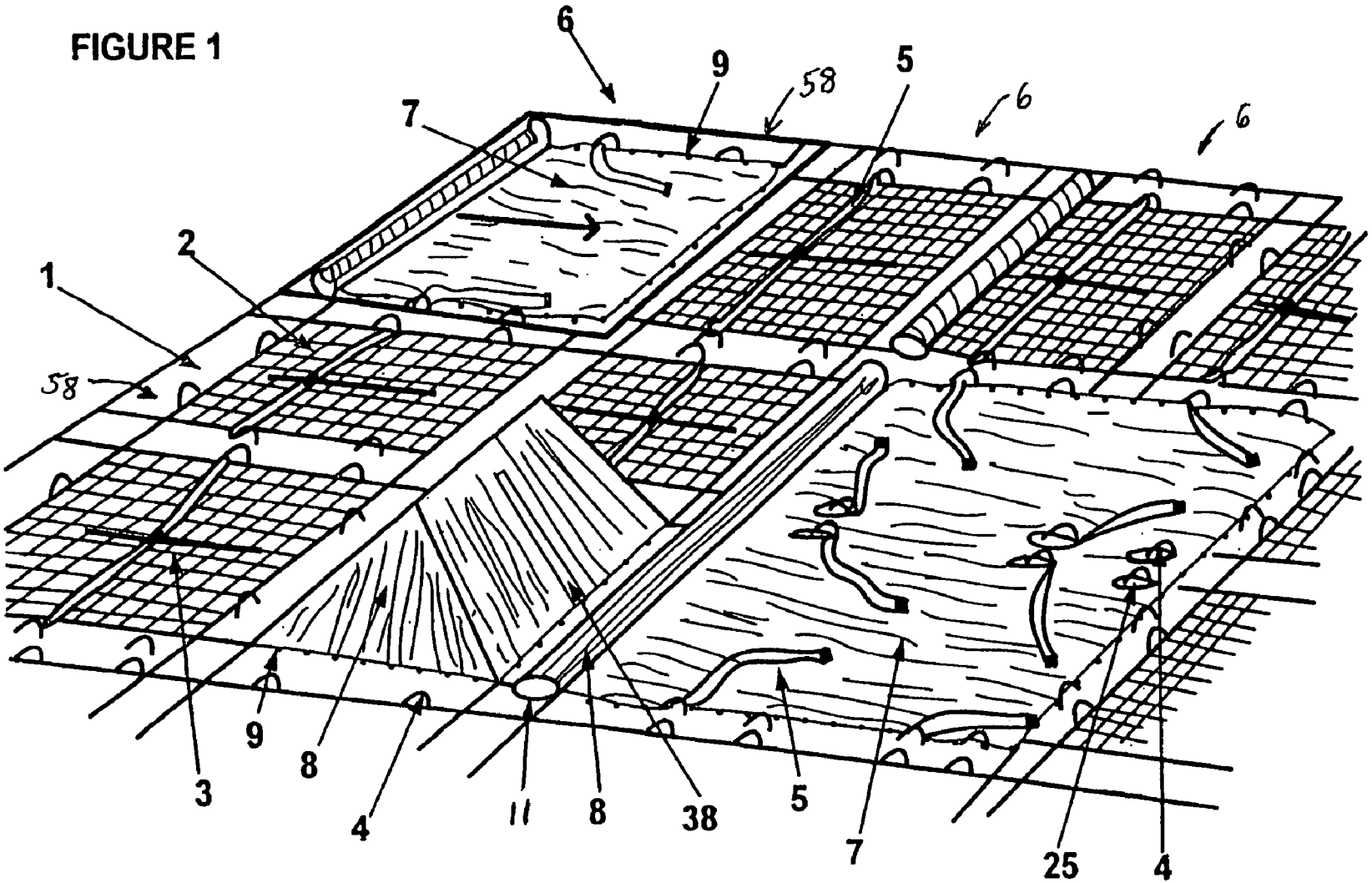
FIG. 1 shows a dual-sided or reversible rescue and safety device in the form of an inflatable raft composed of a grille 1, having the openings formed by the inflated peripheral and internal members 58 defining a plurality of open web or net meshes 6. Each mesh 6 can be provided with an open-mesh netting section 2, that has resealable access openings 3, personnel safety handles 4 and safety belts 5. Along one side of a mesh netting 2, an elongated open bag 11 is releasably secured to inflated member 58. The bag 11 provides a rugged cover for containing a web compactly folded, which when unfolded, forms a shelter portion 8 and an unfolded web or membrane used as a floor 7. In the embodiment of FIG. 1, the floor 7 covers one or more mesh netting sections 2. The floor 7 is provided with slits or openings 25 to expose handles 4. The floor 7 is fastened to the grille 1 by means of snap fasteners 9 indicated by points in the drawing. The shelter 8 is provided with personnel inlet and outlet opening 38 and is mounted and fastened to the grille 1 by snap fasteners 9, and a section of floor 7, fixed by snap fasteners 9, covers the netting. On parts of floors 7, safety belts 5 are open to permit the floor 7 to be stretched into position. Thereafter, they can be closed so that they will be ready for use, if needed.

In a non-restrictive example of an embodiment, the present devices are comprised of an inflatable grille 1, FIG. 1, which is expanded by means conventionally employed in the inflatable field, whose meshes 6 are fitted with netting 2 which is provided with unlockable, spreadable and lockable opening 3, handles 4 and safety belts 5, which are distributed on the grille 1.

In the first step, during a shipwreck and inundation, persons caught beneath the device, which is expanded, unlock openings 3 and move onto the device, lock these opening, FIG. 1.

Figure 2A:
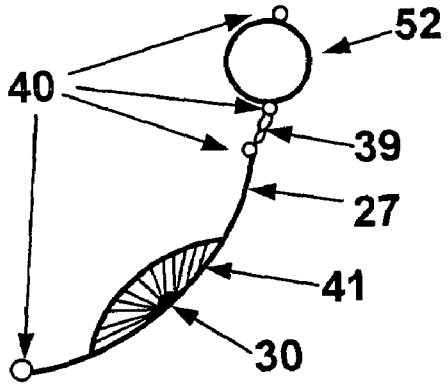
FIG. 2*a* shows an apertured fabric strip 27 provided with accordion pleated section 41 in the form of a bellows with a stabilizing weight 30, which can be lead, and positioned in the center of the strip 27. Also shown in FIG. 2*a* is a snap-hook 39 and rings 40 at its ends which attach the strip 27 to the weight-supporting tube 52.
Figure 2B:
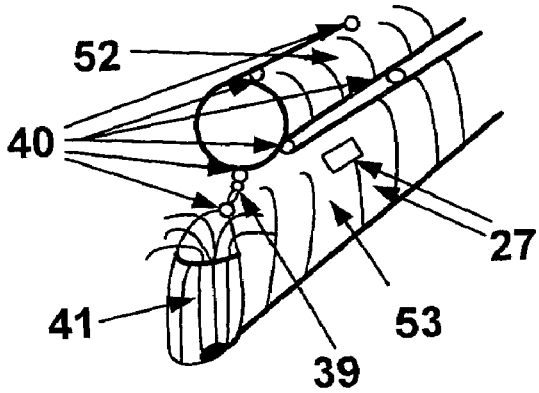
FIG. 2*b* shows a weight-containing member 53, the apertured fabric strip 27 with weight 30 in its center, the strip being attached, by means of a plurality of snap-hooks 39, that engage rings 40 attached to the weight-containing member 53. Two series of rings distributed in two opposing lines on the weight-supporting member 52 permit the placement of the weight element 30 below the raft regardless of how the raft is initially disposed in the water.
Figure 3A:
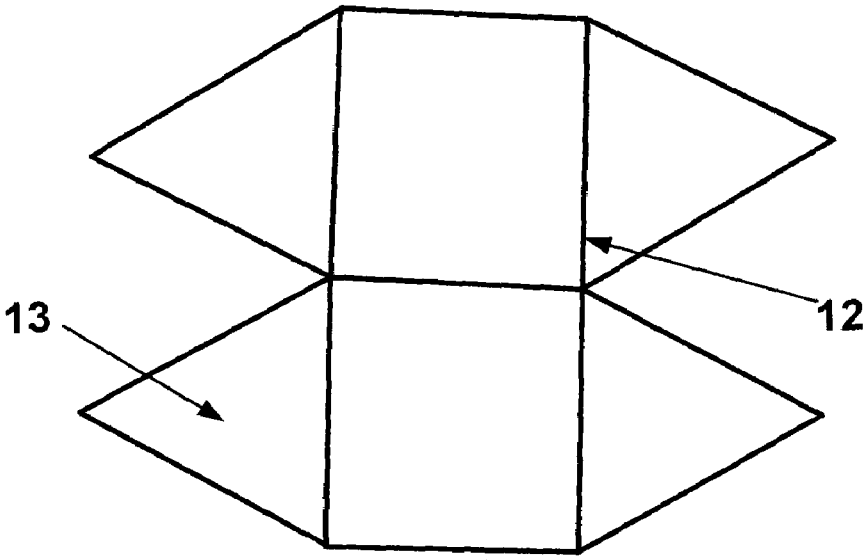
FIG. 3*a* shows a modular shelter 12 fitted with rectilinear shelter structural 12H in the form of an H, unfolded covered by two adjacent rectangular fabric panels along with four integral triangular panels 13. The marginal edges of the panels forming this shelter portion are provided with fasteners, e.g., zippers or hood and loop fasteners.
Figure 3B:
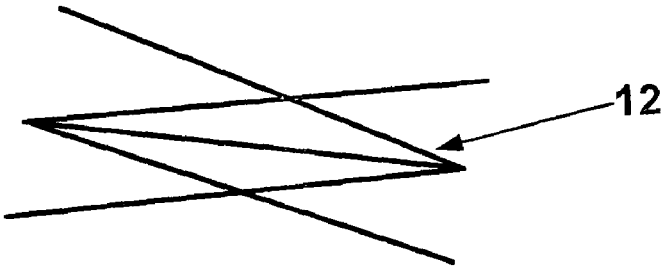
FIG. 3*b* shows the structure 12 in the form of an H, in a semi-folded position.
Figure 4:
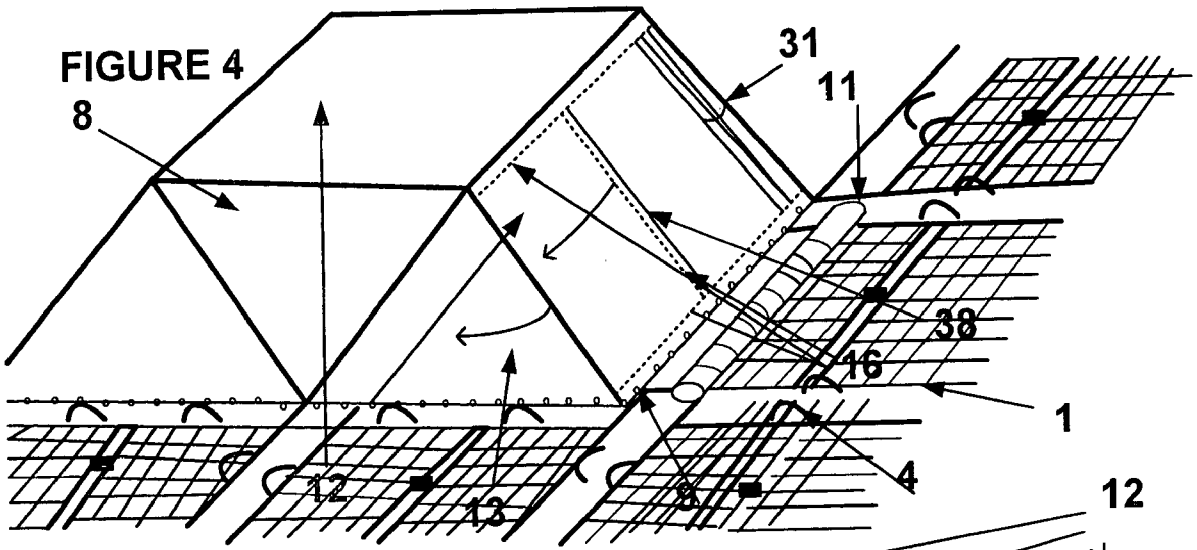
FIG. 4 shows shelters 8, whose two structures 12 in the form of an H are in place, the second structure and two triangular panels 13, one of each side being folded back towards the left, the second parallelepiped of the second structure forming an inner wall, (not shown). The base of the shelter 8 is fixed to the grille 1 by means of a plurality of snaps indicated by element 9. Also shown are handles 4 and bag 11 and an access opening 38 provided with zippers indicated by the dash lines 16, as it occurs for the inner wall, with a fastener 31 allowing for disengaging two panels from the wall on sides, the base of the shelter is joined, in this example, to the grille by means of snaps 9, which can be plastic or a corrosion resistant metal.
Figure 5:
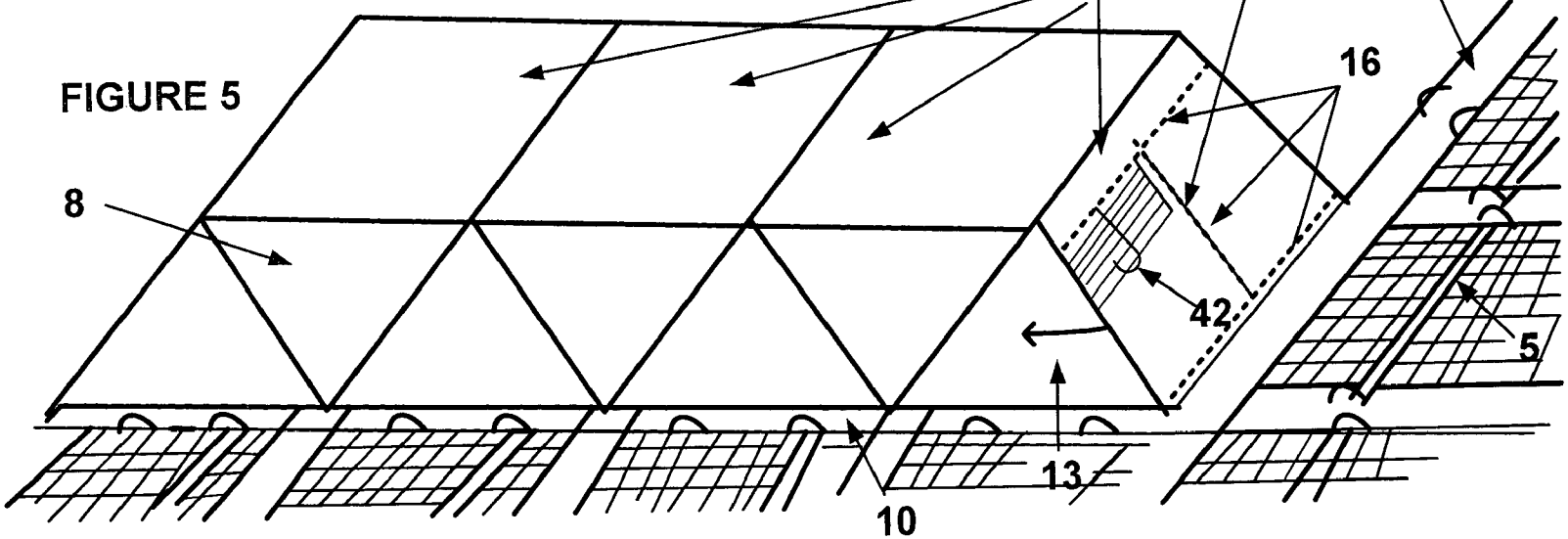
FIG. 5 shows a shelter 8 comprising four structures 12 each in the form described in FIGS. 3*a*, 3*b*, the fourth structure and two triangles 13, one of each side, are folded back towards the left, forming three inner walls that can be opened and disengaged by zippers 16, (not shown). Those structures are joined together to form a tunnel and the base on its periphery is fixed, in this example, to the grille by closing means, such as hook and loop fasteners 10 (e.g. VELCRO), the location of which are indicated along lines 10. At the end of the tunnel, an access opening 38 is provided, which is closed with zippers 16 indicated by dash lines, to permit opening the inner walls of the shelter or disengaging the entry upward by the means of an adjustable fastener 42, four structures that occupy four sections of mesh netting 2 are provided with safety belts 5.
Figure 6:
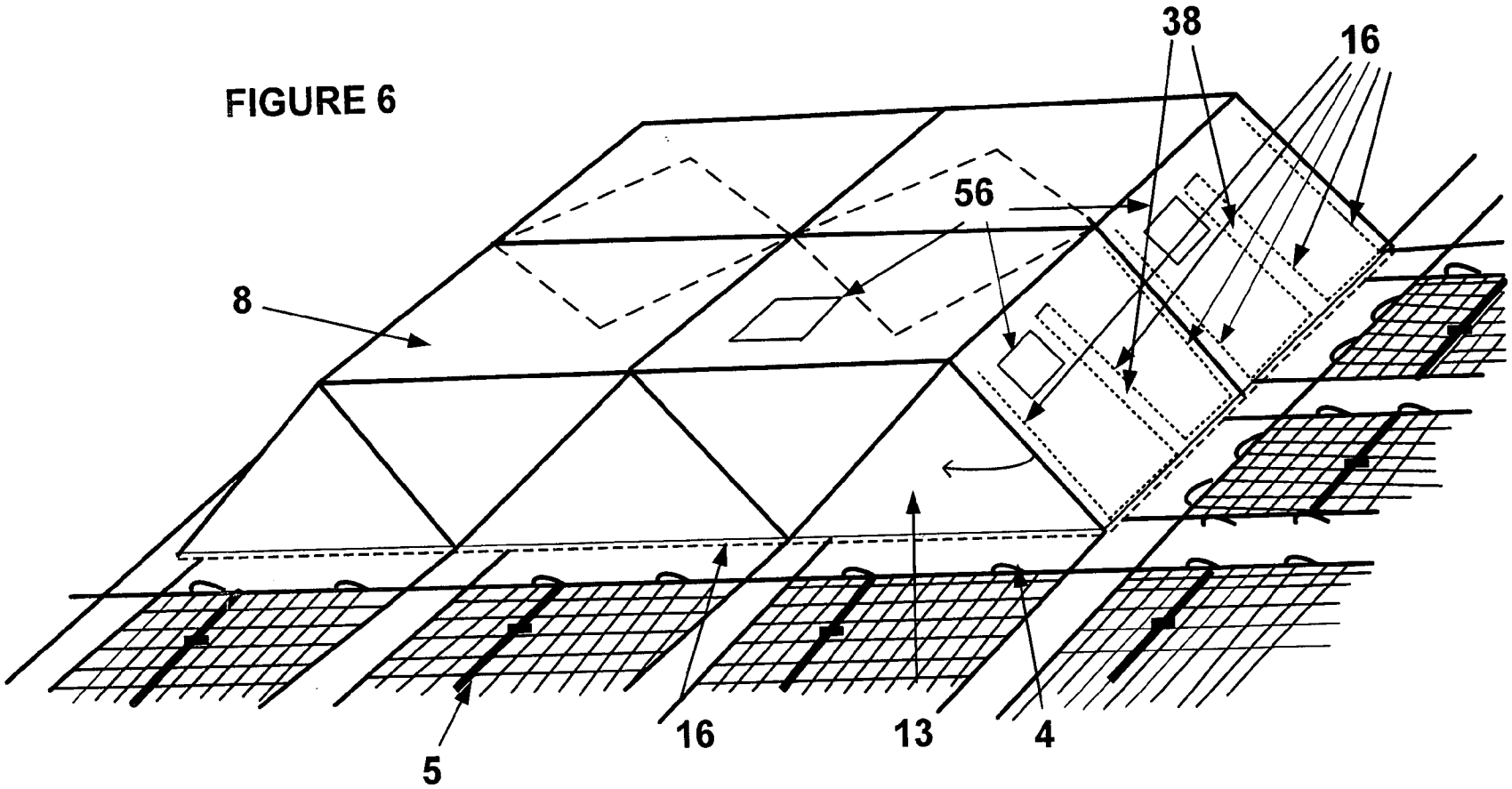
FIG. 6 shows a shelter 8 comprising six structures 12 in the form described, two structures at the end of the shelter, as well as its two triangles on the sides 13 are folded back from inside towards the left forming three inner walls that can be opened and disengaged by zippers. The structures are positioned in a rectangular orientation, roofs are joined by fixing triangles one under the other at roof level, the base of the shelters are fixed by means of zippers 16. Handles 4 and safety belts 5 are provided on the device. The inlet/outlet access opening 38 is provided with zippers 16 for opening inner walls or disengaging the entry, windows 56, the six structures covering six mesh netting openings.
Figure 11A:
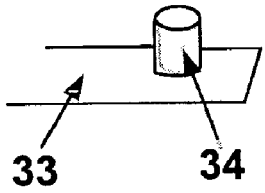
FIG. 11*a* shows a male part attachment means for securing bags, handles, and the like in the form of a tab portion 33 provided with a push-button 34.
Figure 11B:
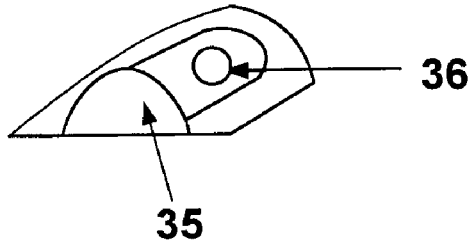
FIG. 11*b* shows a female receiving piece in the form of semi-cylindrical receiving member secured to a support panel 35 and provided with an orifice 36 adapted to receive the extended push-button 34 of the male part.
Figure 12A:
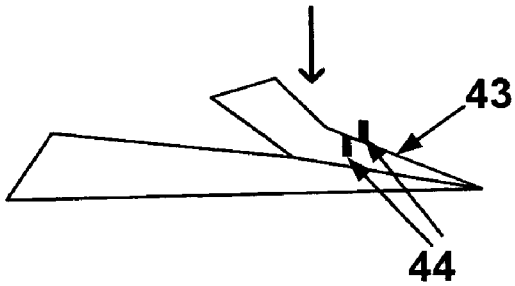
FIG. 12*a* shows another male fixing mode for bags, handles, and the like, where a tab 43 is folded on itself with a section to be pressed from above, the tab being provided with two projecting lugs 44.
Figure 12B:
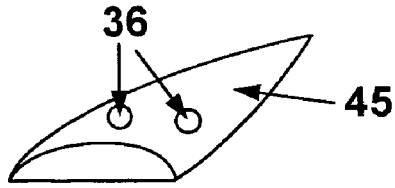
FIG. 12*b* shows the female partially conically shaped receiving part 45 provided with two orifices 36 into which lugs 44 are engaged for securing the mated portions together.

In the second step, personnel stabilize the raft by adjusting, if necessary the weight 30 element to the desired suspended position, as shown in FIG. 2*a* and FIG. 2*b*. If the raft is upside down, safety belts 5 that were attached when the raft is expanded, can be viewed through the netting Personnel disengage handles 4 and safety belts 5 simultaneously and move firstly onto the device, through openings in netting 2 if they are wide enough, or by openings 3 which will be opened, or along the fastening of the netting. The personnel fix handles 4 at the new location on the device, disengage one end of the bag, then the other, to pivot it about itself to expose it on the same path, fix it at a desired location on the surface of the raft by means of the fastening receiving part 35 or 45, as shown in FIGS. 11*b*, 12*b*, extend the web of floor 7, to a position shown in FIG. 1, and fix the floor panel 7 by fastening means provided for this purpose, such as VELCRO® strips 10, in order to provide a much drier surface.

In the third step, personnel organize the mounting of one or more shelters 8. A shipwrecked person unfolds the web which is used for the floor 7, unfolds the structure in the form of spider 19 as illustratively shown in FIG. 8, connects manual pump 20 at valve 24 to the structure, immerses the intake pipe 21 in the water, as by sliding it between the floor and the side of the mesh of the grille. Pumping continue until the structure becomes rigid, and two of the upright supports 22 are fixed to the edge of the mesh by the fastener (e.g. VELCRO®) 10 on the grille. The next structure is erected and pleated bellows 17 that is held by fasteners 31 is disengaged to release the two removable upright supports 22 of the first structure to join them with the VELCRO® fastener 10 provided on the top part of the second structure; bellows 17 are opened to create the necessary length. Another individual can mount the next shelter, if they decide to have more space, wherein the lateral panels 18 are raised and fixed one above the other under the roof of the adjacent shelter by the VELCRO®, fastener 10. The base of the shelter is secured with zippers 16 provided on the device. Once completed, the shelters provide weatherproof covering and individuals can hold handles 4 and reach safety belts 5. If water enters, it can be discharged by lifting up a corner of the floor 7.

Figure 8:
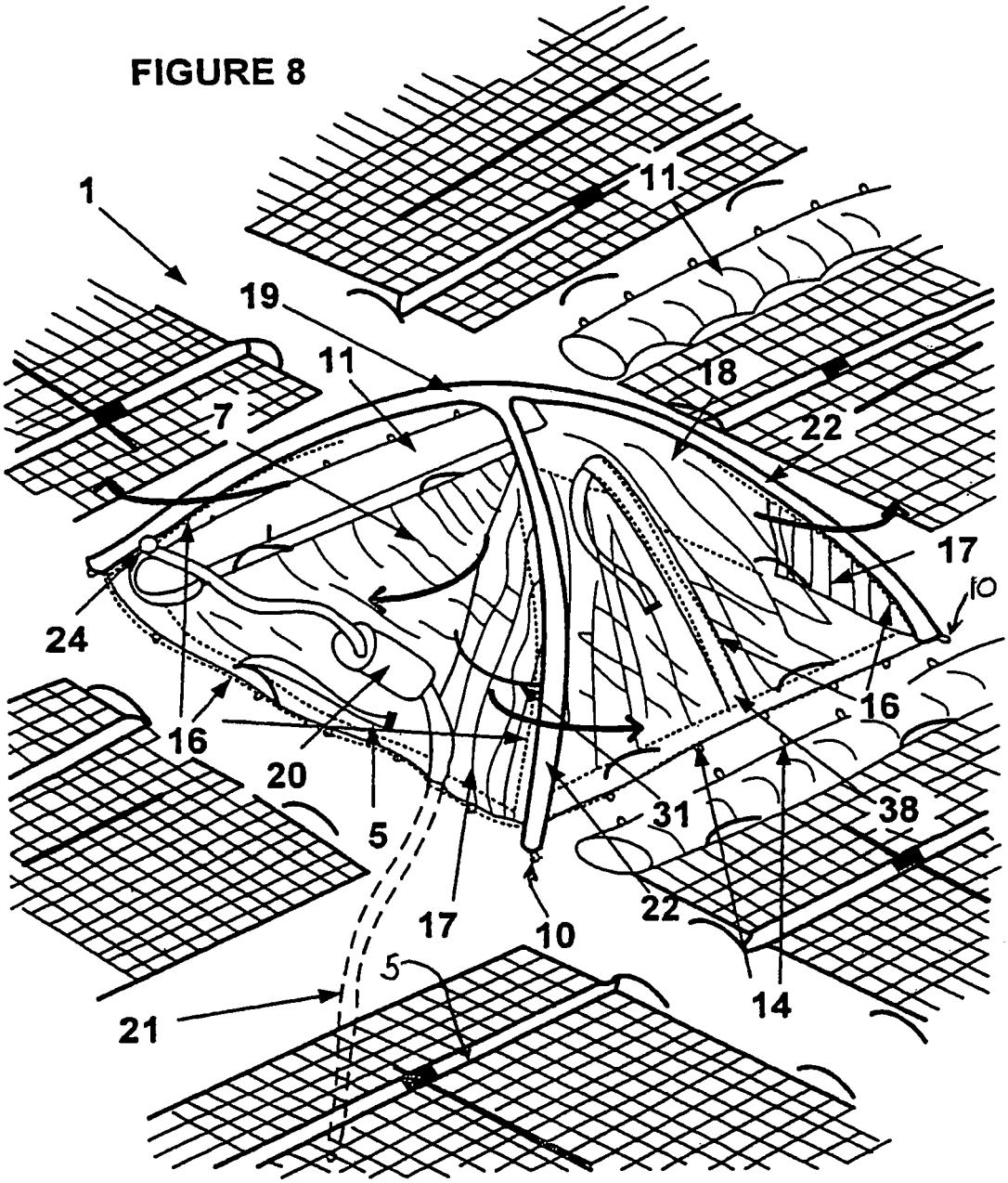
FIG. 8 shows a structure in the form of an inflatable spider-like supporting framework 19 that is inflated by means of a manually-powered pump 20. The pump 20 includes an intake pipe 21 which is extended into the water, and the pump 20 is fixed on an upright post by nosepiece 24. The two upright posts 22 are fixed to the grille by strips 10 of hook and loop fasteners 10, such as VELCRO® that are indicated by small dots in the drawing. On lateral panels 18 there are pleats or bellows, in the form of accordion folds 17 provided with fasteners 31 to permit expansion of the shelter in order to fix two upright posts 22 to an adjacent shelter. One of the sides includes a personnel inlet/outlet or access opening 38 with a zipper 16. The lateral panels 18 are also provided with a zipper 16, as is the base periphery of the shelter, which is joined to the grille by the same means. These zippers are indicated by dotted lines. Safety belts 5 are shown opened inside the shelters, ready to be used; they are shown locked on the rest of the grille 1. An open bag 11 is shown in the shelter. The floor 7 is stretched and fixed by a zipper 16 to the grille. Cords 14 are also provided on the rear side of bag 11, on the edge of upright posts, shelters and floor portions. A second bag 11 is shown secured to an adjacent inflatable grille member 58, ready to be disposed over the adjacent mesh netting section.

In the circumstance where the raft and those aboard make landfall, and desire to camp on the land, one or more bags 11 can be removed from the raft to establish a campsite on land by means of conventional tent pegs, fasteners, cords and the like 14 stowed inside the bag 11 and that can be attached to the periphery of shelter 8 and the floor 7, as shown in FIG. 8.

This type of tent which fits in an elongated bag is suitable for use with or without rescue boat, and it is not necessary to provide the ends of the bag with male fasteners. Rather, cords are used for fixing tent pegs anchored to the ground and the floors. Shelters can also be joined together on land using similar attachment procedures.

With regard to fastening of panels and floors to rods, fasteners, cords or button holes, pressure straps, straps with knobs, hook and loop fasteners, snap hooks, sealed zippers, eyes with fasteners can be used, and those are not to be limited.

Webs forming the floor and shelter portions can be joined to the bag 11 in any available manner known to the art. They can be adhesively bonded, heat-sealed, sewn, and then rolled, folded on themselves, held by elastic straps, straps with fasteners, VELCRO® fasteners, snap-hooks, zippers, cords and knobs, and the like.

The exterior of bags 11 are preferably provided with handles, straps, VELCRO® attachments, or other means to facilitate grasping them.

Two webs are interconnected in a bag, they are fixed one after the other, where the web forming the floor is in the front and the web forming the shelter is in the rear. Bags are removably fixed on the grille by means of male receiving fasteners 33 and 43 which are distributed on both sides of the device. Female fasteners 35 and 45 are fixed on the ends of bags 11 and adapted to receive male fasteners. The male fasteners are positioned along the greater part of, or the whole grille for retaining a predetermined number of bags 11 on the grille. Each bag contains two webs forming the floor 7 and the shelter 8, which make the device lighter because bags are not positioned all over and there is the choice to set up shelter(s) at location(s) where desired, as determined by the circumstances. Similarly, handles 4, are made to be removable using the same kind of male/female fasteners.

Figure 11C:
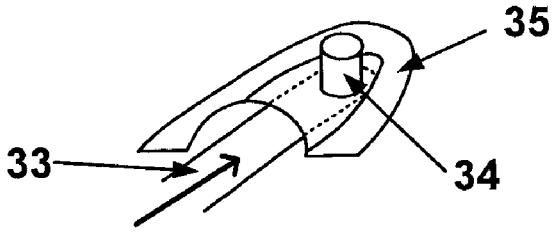
FIG. 11*c* shows the tab 33 engaged in the receiving channel 35, the push-button 34 extending from the orifice 36.

The removable fasteners for bags 11 containing modular floor and shelter units, are female receiving pieces in the form of a half-cone 35 (FIG. 11*b*) for example, with an orifice 36 and are fixed on rods or tubes. A male pull tab or spring tab system with a push-button 34 (FIG. 11*a*) is received in the female portion for example. This button engages the orifice and holds the bag 11 to the grille, as shown, e.g., in FIGS. 11*a*, 11*b*, and 11*c*. In another embodiment illustratively shown in FIGS. 12*a* and 12*b*, a tab is folded on itself forming spring 43, with a space for locating the bag. This tab is provided with two lugs 44 that engage two mating orifices 36 provided for this purpose on female a receiving piece fixed on the inflated tube. Male fasteners are mounted on the edges of the bag or, for example, to ends of a flexible strip fixed under the bag. The strip can be adjustable in length to accommodate a dimension of the bag, and can be inserted into a hem or seam with open ends. Numerous other embodiments and variations will be apparent to one of ordinary skill in the art.

A similar receiving piece can be adapted for removably fastening handles 4, e.g., two receiving fasteners being bonded, heat-sealed on a plate or mould, the plate with fasteners then being heat-sealed to the rod or tube. By withdrawing the handle and pressing the button 34 or tab 43, the handle 4 is disengaged from one end then from the other. It can then be moved from the submerged to the upper side of the rat.

In an alternative embodiment, the handles 4 are permanently mounted and secured to both sides of the raft, and are not removable.

These types of fasteners can be adapted for fixing stops and upright posts 22 to the grille. It is also possible to use clips of safety belts and zippers. These examples are not limited.

All the fasteners for the bags, handles, stops, upright, posts of shelters, fasteners of floors will be disposed on two sides of the grille.

In another embodiment, bags are made to be removable by a fastener composed of a tube provided with a slit 32 fixed along the edge of the bag as a receiving piece and of a female seal bead 26 fixed on a fabric or other thin piece of material 23 joined to the grille. The seal bead 26 is slid by means of a slit inside the tube. The seal bead can be in an extension of the fabric or at right angles and fixed within the surrounding fabric, as in FIGS. 9*a*, 9*b* and 9*c*.

In yet another embodiment, bags are made to be removable by a utilizing fastener on the bag 11 with flexible, rigid or elastic tubular sections 28 (see FIG. 10*a*), in series along the mesh netting 2 (FIG. 10*c*). The alternative tubular sections of bag 11 and those attached to the mesh are joined by threading rod 29 provided with an eye 29I, which is tied with fastener cords 31 to secure the assembly.

Safety belts can be made removable by snap hooks fixed to each of its ends to allow them to be placed end-to-end and create chains.

To facilitate reversing the position of bags and handles on the raft, the reverse side of the raft is provided with indicia marking their locations in order to save time in finding and disengaging the bags.

The weight element 30 is formed by apertured thin strips 27 forming sections, within surroundings of each strip, a lead weight 30, for stabilizing the weight element, and at each end of each strip provided with pleated part in the form of an accordion 41 and means such as rings 40 and snap-hooks 39 allowing the bottom of the strip to hang up/remove on the rod for forming the weight element and releasing it by fixing it to rings on rods 52 by means of snap-hooks. Rings 40 on the rod 52, are distributed on two lines above and under the raft to ensure that the weight element is always located under the raft or at the necessary position, as shown in FIGS. 2*a* and 2*b*.

Fluid-tight membranes or webs, which are doubled to form pockets can be used for the floor 7 and shelter 8, can be fitted with one-way valves and inflated automatically or by an air-gas generator or manually with a hand-pump, in order to create an insulation from the elements.

Tubular structures can be semi-flexible and/or joined since they are folded to size, they can be formed by folds of membranes, be included in folds or connected to the structure. In folds and hems, it is possible to thread pipes, flexible rods, which can be telescopic, articulatable, bendable, that are provided with pivot devices to cause them to pivot or interlock, and in other ways-known in the art. Pipes and rods that are flexible can be mounted at the time of manufacture.

If structures are inflated by water, an anti-freeze composition, which is to be injected, should be provided as a emergency material.

According to the choice of the user, some rafts are provided with a bag containing a telescopic bar mounted on a pivot, with a sail; oars and oar locks mounted on rods or tubes can be provided; and a plate for fixing a motor can also be provided.

The maximum loading and the number of persons should be indicated clearly on the grille.

The length of membranes, floors and/or shelters can be provided to optionally cover one or several of the mesh net openings. The surface of the device or a raft can be made only of two openings, with a shelter covering one opening and the floor covering two openings. The assembly technique allows the multiplication of sheltered spaces by coupling with adjacent spaces, or if preferred, shelters can be formed individually, and distributed on the surface as desired.

Where a large mesh netting opening is designed to support a predetermined personnel loading, several persons can hold side-by-side in two rows face-to-face in the same mesh, the two last persons at each end grasping handles. Persons who are face-to-face, with safety belts in addition, are supported feet against feet, when the sea is rough.

Figure 7:
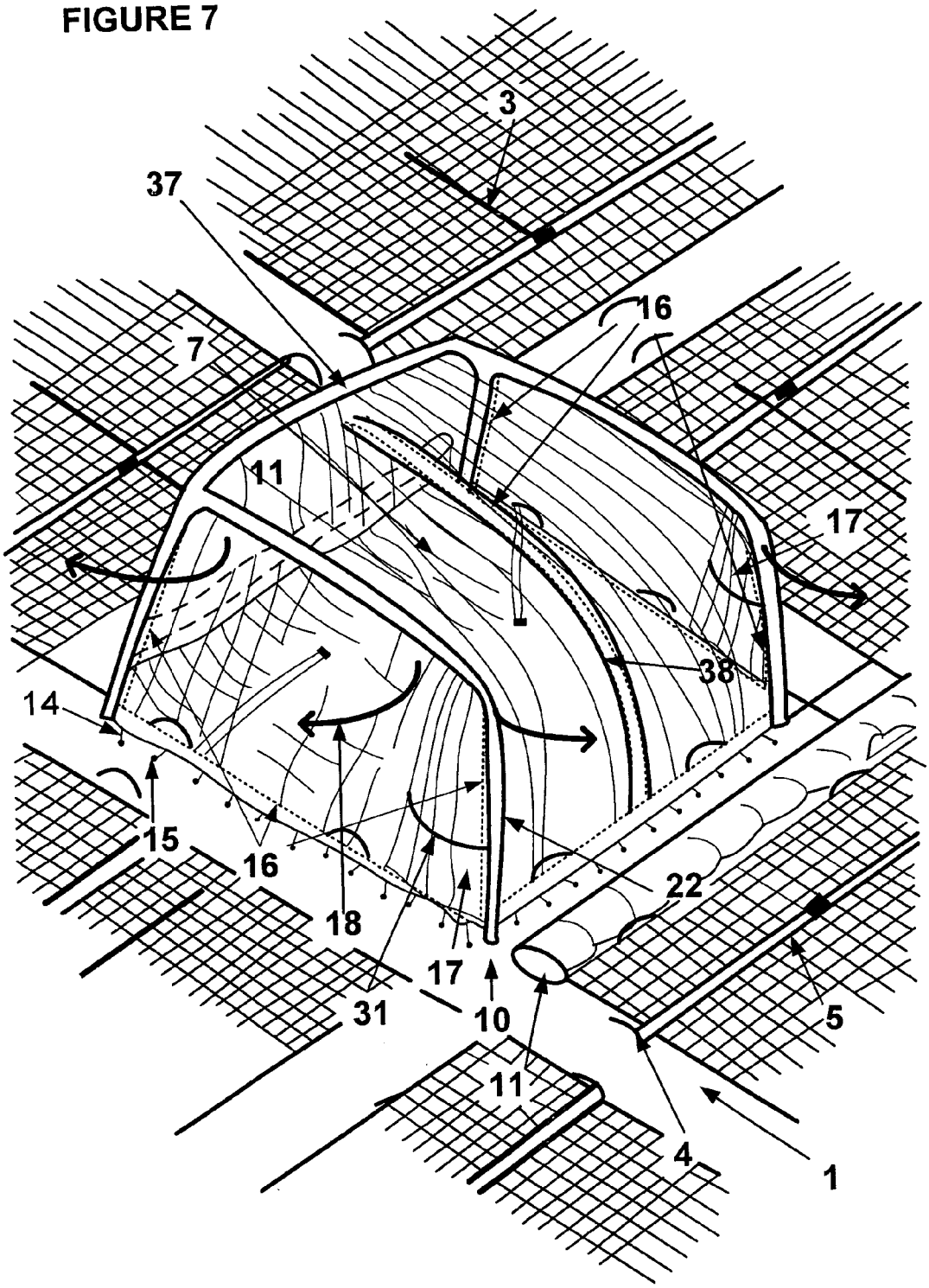
FIG. 7 shows a structure 37 with three side walls, the fourth being removed from the structure at its top to create an opening with a zipper 16. On the two lateral sides 18, there are shown two bellows 17 provided with fasteners 31 permitting the structure to expand as described above in order to connect to the adjacent structure and form a shelter chain, the two vertical lateral panels 18 provided with zippers 16 permitting, when they are opened, panels 18 to be lifted onto these sides and fixed on the shelter from all sides for forming shelters connected to each other and extending along the surface as desired. Also shown are handles 4 and resealable, openings 3. As illustrated, safety belts 5 inside the shelter are open and they were placed on the floor 7 which was stretched and fixed by means of zippers 16, while the other safety belts 5 on the grille are locked. The base of the shelter is fixed to the grille by cords 14 and projecting studs or fasteners 15 and upright posts 22 are held by the hook-and-loop (e.g., VELCRO) strips 10. The opened bag 11 and the other closed bag are shown as an example of the apparatus in use.

The shelter structure 12 using the support in the form of an H applies to parallelepipes. The structure on three sides 37, in the form of a square (or rectangular) shown in FIG. 7 also rests on a parallelepiped, its side 18 panels are raised and include bellows, in the form of an accordion 17 allow panels 18 to be extended in order to have enough length to be fixed on top of the next shelter.

The structure in the form of a spider having radial supports as illustrated in FIG. 8 is also composed of panels 18, whose membrane is raised and a bellows or accordion-folded section 17 permits attachment of its upright posts 22 to the next shelter:

It is not obligatory to fix handles on the side on which bags are fixed. Between two shelters in the case of clearances, the sealing will be ensured by fixing strips between upright posts and roofs, for example, using hook and loop fasteners. On some panels or roofs, transparent panels forming windows 56 can be provided.

Depending upon the diameter of the inflated members 58, floors can be flush with handles or to the rear of handles. In that case, openings or slits 25 are provided to provide access to handles 4. The inflatable members and sections can be protected from friction by flexible reinforcing strips, as commonly used in the field of inflatable articles.

Figure 13:
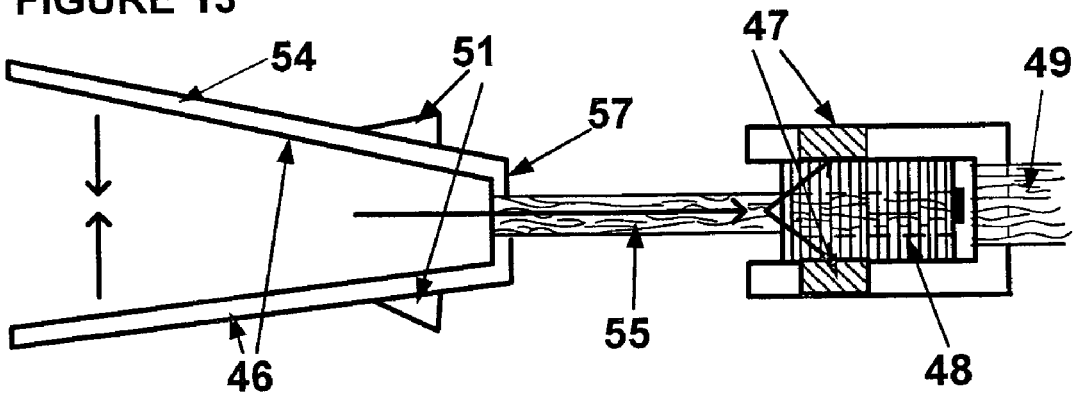
FIG. 13 illustrates an example of a fast locking/opening manually operated device comprising a male part formed with two flexible levers or handles 46 on axis 57, with a protruding element 51 adapted to positively engage mating openings, 47 formed in the female part 48 when the pressure is released. The male part 54 is joined to the female part 48 by a flexible strap or safety 55, which prevents the male part from falling into the water. The female part 48 is joined to the mesh netting 2 by a strap 49.

Resealable openings 3 are made to be unlockable and lockable from either side for example by strips of VELCRO®, with a handle on each strip. Nippers of the pincer type, with a spring and long, wide ergonomic arms that can be grasped, one of the arms of pincer being provided with a link connected to the netting to avoid the pincer from failing into water, jaws of the pincer surrounding the opposing edges of the access opening. By means of a pincer, it is possible to be grasped, of which arms forming flexible levers 46 are mounted in one block to the axis 57, each provided with a protruding part 51. These protruding parts 51 of levers engage a female receiving piece 48 which is provided with two orifices 47 to meet two protruding parts 51. This type of pincer can be laid flat, as shown by FIG. 13.

According to standards and the effective technique for rescue boats, the grille will be constructed with air-tight compartments and/or with an inner wall forming an air chamber, these compartments being composed of one or a plurality of one-way valves, as well as with pressure relief valves.

Any known inflation systems can be used. Where the manufacturer selects a system with straps or pull cords for releasing compressed air or other gas from one or more pressurized containers, the straps are guided by wheels, pulleys, conduits or other known means that permit the small cords to slide. These elements are fixed to rods, and straps, and small cords are connected to a single handle, such as a loop accessible from outside of the container. Compressed air bottles or other gas generators can be placed in a protective pouch or fixed by straps, or by other customary means known to the art. The grille expands from a protective cover or a bag which is opened, for example by yielding to the inflation pressure.

According to the certification standards imposed by various national safety authorities, the device must be equipped with all means required to ensure the reliable inflation of the raft and all customary emergency supplies such as cords on rods, ladders, anchor, complete outfitting with emergency and rescue kits, accessories, reflecting bands, oar locks, and the like.

As will also be apparent from the above detailed description, a bag affixed fixed to the inflated grille, containing and covered by an opaque web floor, with or without a shelter, is suitable for placement in a swimming pool for safety purposes and also to provide sunlight protection to reduce heating of the pool water and also to reduce heat loss when the pool is not in use at night or on cool days.

The invention claimed is:

1. A rescue and safety apparatus for receiving personnel in aquatic environments of the type having an inflatable grille structure formed by one or more peripheral members defining an enclosed area and a plurality of internal members to thereby define a plurality of regularly-spaced open regions within the enclosed area, the peripheral and internal members being tubular and formed from a flexible, collapsible watertight material, and having a flexible open-mesh netting extending over the open regions and secured to at least one of the one or more peripheral members and the internal members, said netting being provided with at least one resealable personnel access opening that is located in an open region between the adjacent members, the inflatable grille structure having substantially similar opposing surfaces when inflated, a) a plurality of fastening elements secured to each of the opposing surfaces of the grille structure, b) at least one floor and shelter forming module releasable secured to the inflatable grille structure in a compactly folded configuration, whereby said floor and shelter forming module, when released and unfolded, is attachable to the upper surface of the inflated grille to provide a modular personnel shelter having a floor panel supported by the open-mesh netting, the shelter extending upwardly over the floor panel.

2. The apparatus of claim 1, wherein the shelter is extended by support means, the support means being selected from the group consisting of rigid rods, flexible rods, studs, posts, fluid-tight inflatable channels provided with valves, and combinations thereof.

3. The apparatus of claim 1, wherein at least one wall of the shelter is provided with a sealable personnel access opening.

4. The apparatus of claim 1, wherein the shelter is provided with at least one sealable ventilation opening.

5. The apparatus of claim 1, wherein the unfolded floor and shelter module is attached to the upper surface of the inflated grille by attachment means selected from the group consisting of zippers, hook and loop fasteners, snaps, flexible tie cords, interlocking loops, manually releasable interlocking male and female connectors, and combinations thereof.

6. The apparatus of claim 1, wherein the compactly folded floor and shelter forming module is disposed in a bag that is releasably secured to a surface of the grille structure.

7. The apparatus of claim 6 which further comprises earth-engaging tent pegs secured in the bag, whereby the floor and shelter forming module can be erected on, and secured to land.

8. The apparatus of claim 1 which further comprises a weight-supporting element joined to the inflatable grille, a weight-containing member releasably attachable to fasteners secured to opposing surfaces of the weight-supporting element and a stabilizing weight element positioned for suspension in the weight-containing member, whereby the relative position of the weight-containing member can be changed in order to suspend the stabilizing weight element below the inflated grille, regardless of the initial orientation of the grille in the aquatic environment.

9. The apparatus of claim 8, wherein the weight-supporting element is releasably attached to the weight-containing member by engagement of snap-hooks with receiving rings.

10. A rescue and safety device, comprising:

an inflatable grille forming a periphery of said device and having a plurality of meshes coupled within the inner periphery of said grille, each mesh having a netting disposed therein, wherein said plurality of meshes and corresponding nettings form opposing and reversible underside and topside surfaces of said device;

at least one bag removably coupled to one of the surfaces of said device, each bag including a first membrane being extendable from said bag across one of the meshes and corresponding netting and defining a floor surface along the topside surface, a second membrane being expandable from said bag and positioned over said floor, and a plurality of posts positioned in an upright direction between the floor surface and the second membrane to maintain said second membrane over the corresponding floor surface and define a shelter area therebetween;

a plurality of handles removably attached to said opposing underside and topside surfaces of the device; and wherein each netting includes a sealable opening to provide access there through from either of the underside or topside surfaces.

11. The device of claim 10, wherein the at least one bag comprises a plurality of adjacent bags, wherein the first and second membranes from each bag are adapted for coupling to adjacent first and second membranes to form contiguous floors and corresponding shelters on said topside surface.

12. The device of claim 10, further comprising a plurality of safety belts removably attached to said opposing underside and topside surfaces of the device.

13. The device of claim 10, wherein said underside and topside surfaces comprise a plurality of fasteners for removebly attaching said first and second membranes about their respective peripheries.

14. The device of claim 10, wherein said second membrane expands into two parallelepipeds interconnected by an H-shaped structure, said H-shaped structure formed by a pair of opposing leg portions attached to opposing ends of a central portion, and a pair of rectangular fabric panels and four integral triangular panels, where the leg portions of the H-structure rotatably fold to a position substantially parallel with the central portion of the H-structure, said H-structure being stored in its folded position with said first and second membranes in said bag, said H-structure being reinforced when filled with one of water, gas, air, rods, or pipes on the sides of the H-structure, said H-structure having a pair of rectangular fabric panels and four integral triangular panels coupled over the H-structure, and wherein said four panels are formed as triangles and allow, when the H-structure is raised over the floor, closure of the shelter by fixing, on each side, one of said triangular panels over the other, and fixing a bottom periphery of the shelter to the top surface of the device.

15. The device of claim 10, wherein said at least one bag comprises at least two bags that are expandable into corresponding at least two structures, each structure including an H-shaped structure formed by a pair of opposing leg portions attached to opposing ends of a central portion, and a pair of rectangular fabric panels and four integral triangular panels, said at least two structures being interconnected by the central portion of the H-structure, which forms a roof, said structures being reinforced when filled with one of water, gas, air, rods, or pipes on the sides of the H-structure, and wherein said panels are formed as equilateral triangles that form sides and allow, when the structure is raised over the floor, closure of the shelter by connecting two triangles of the structure at each end one above the other in order to form a multiple shelter in the a form of a tunnel, wherein one rectangular fabric panel of each H-structure forms an inner wall that can be removeably attached to the floor, and wherein the periphery along the bottom of the shelter is fixed to the top surface of the device.

16. The device of claim 10, wherein said shelter comprises membranes associated with six bags that are expandable into corresponding six structures, each structure including an H-shaped structure formed by a pair of opposing leg portions attached to opposing ends of a central portion, and a pair of rectangular fabric panels and four integral triangular panels, said six structures being interconnected by the central portion of the H-structure, which forms a roof, said structures being reinforced when filled with one of water, gas, air, rods, or pipes on the sides of the H-structure, and wherein said panels are formed as equilateral triangles that form sides of the shelter and allow, when the structure is raised over the floor, closure of the shelter by connecting external two triangles of the structure at each end one above the other, and fixing two internal triangles of the structure to the rectangular panels forming the roof in order to form a multiple shelter in the a form of a tunnel, and wherein the periphery along the bottom of the shelter is fixed to the top surface of the device.

17. The device of claim 10, wherein said upright posts consist of folds, and are adapted to receive one of a fluid, a rod and a pipe.

18. The device of claim 10, wherein said shelter area is shaped as a pyramid having three sides that are inflatable by at least one of a pump, an air generator and a gas generator.

19. The device of claim 10, wherein said floor surface includes a plurality of apertures, where each aperture is sized to accommodate handle.

20. The device of claim, 10, wherein said second membrane includes three sides formed by panels having accordions for extending said panels to adjacent spaces.

21. The device of claim 10, wherein said at least one bag further comprises a telescoping mast and oars, the mast and oars being stored therein.

* * * * *